US007238394B2

(12) United States Patent
Morita et al.

(10) Patent No.: US 7,238,394 B2
(45) Date of Patent: Jul. 3, 2007

(54) POWDER COATING APPARATUS AND METHOD FOR ELECTROSTATICALLY COATING AN ELECTRICALLY GROUNDED OBJECT

(75) Inventors: Tadao Morita, Tokyo (JP); Hiroki Murai, Tokyo (JP); Kosei Yabe, Tokyo (JP); Akira Nakamura, Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 215 days.

(21) Appl. No.: 10/493,382

(22) PCT Filed: Nov. 5, 2002

(86) PCT No.: PCT/JP02/11522

§ 371 (c)(1),
(2), (4) Date: Apr. 23, 2004

(87) PCT Pub. No.: WO03/041867

PCT Pub. Date: May 22, 2003

(65) Prior Publication Data

US 2004/0255865 A1 Dec. 23, 2004

(30) Foreign Application Priority Data

Nov. 16, 2001 (JP) ..... 2001-351722
Jun. 28, 2002 (JP) ..... 2002-189395

(51) Int. Cl.
*B05D 1/04* (2006.01)
*B05B 5/053* (2006.01)

(52) U.S. Cl. ..... 427/475; 427/458; 118/621; 118/629

(58) Field of Classification Search ..... 427/475, 427/458; 118/621, 629
See application file for complete search history.

(56) References Cited

U.S. PATENT DOCUMENTS 4,011,991 A * 3/1977 Masuda ..... 239/708
4,745,520 A * 5/1988 Hughey ..... 361/228
5,506,746 A 4/1996 Seitz
6,227,465 B1 5/2001 Kelly

FOREIGN PATENT DOCUMENTS

JP 59-127666 7/1984

(Continued)

OTHER PUBLICATIONS

Websters Third international Dictionary, 1981, p. 2080.*

*Primary Examiner*—Fred J. Parker
(74) *Attorney, Agent, or Firm*—Wenderoth, Lind & Ponack, L.L.P.

(57) ABSTRACT

In a powder coating apparatus a pulse signal S2 of a low voltage generated by a pulse signal generation circuit (7) is boosted to a high voltage by means of a high voltage impression circuit (8), so that it is impressed upon corona electrodes (5). As a result, a corona discharge is intermittently generated from the corona electrodes (5) toward an object to be coated, whereby powder coating material sprayed from a nozzle opening of a gun main body in a forward direction is charged with negative ions developed by the corona discharge, whereafter it is directed toward the object to be coated, and is deposited on a surface of the object.

11 Claims, 7 Drawing Sheets

FOREIGN PATENT DOCUMENTS

| | | | |
|---|---|---|---|
| JP | 6-218546 | | 8/1994 |
| JP | 11-60759 | | 3/1999 |
| JP | 2001-96201 | * | 4/2001 |
| JP | 2002-135615 | | 5/2002 |
| JP | 2002-173763 | | 6/2002 |

* cited by examiner

POWDER COATING APPARATUS AND METHOD FOR ELECTROSTATICALLY COATING AN ELECTRICALLY GROUNDED OBJECT

BACKGROUND OF THE INVENTION

1. Technical Field

The present invention generally relates to a powder coating apparatus and method, and more particularly, to such a powder coating apparatus and method for spraying charged powder coating material on to an object to be coated so as to apply it to the object while using static electricity.

2. Description of the Related Art

Attention has been focused on electrostatic powder coating as a painting or coating method of the environment-friendly and pollution-free type without using any solvent from the viewpoint of environmental protection. In this electrostatic powder coating, powder coating material is supplied from a paint tank through an injector to a spray gun, where it is injected or sprayed, together with a carrier air stream, to an object to be coated from a nozzle opening formed at a tip end of the spray gun. At this time, a high voltage is impressed upon a corona electrode which is provided at the tip end of the spray gun with the object to be coated being grounded, so that a corona discharge is generated from the electrode of the spray gun toward the object to be coated. As a result, when the powder coating material injected from the nozzle opening passes through the neighborhood of the electrode, it is charged through its collision against ions generated by the corona discharge. The powder coating material thus charged is deposited on the surface of the object to be coated under the influence of the carrier air stream and electric forces generated along the electric lines of force.

However, when the corona discharge is continuously carried out, the generation of the corona discharge may be suppressed by a space charge of negative ions developed by the corona discharge itself, thus resulting in difficulty in providing a uniform corona discharge from the corona electrode. As a consequence, there might be a fear that the efficiency of coating to the object to be coated is reduced.

In addition, there might also arise another problem as stated below. That is, the surface potential of a coating film on the object to be coated increases gradually due to the coating of the charged powder coating material, there would take place dielectric breakdown between the surface of the object to be coated and the surface of the coating film. Therefore, the gas present therearound is ionized to release positive ions, so that there could be developed a so-called back ionization in which the negative ions generated by the corona discharge are neutralized by the positive ions, thus resulting in reduction in the quality of the coating film.

SUMMARY OF INVENTION

The present invention is intended to solve the problems as referred to above, and has its object to provide a powder coating apparatus and method which are capable of improving the efficiency of coating to an object to be coated as well as providing a coating film of excellent quality thereon.

A powder coating apparatus according to the present invention is provided for electrostatically coating a surface of an electrically grounded object to be coated with charged powder coating material. The apparatus comprises: a gun main body for spraying the powder coating material toward the object to be coated; at least one corona electrode arranged at a tip end of the gun main body for charging the powder coating material thus sprayed; and a pulse high-voltage generator for impressing a pulse-shaped high voltage upon the corona electrode to generate a corona discharge.

A powder coating method according to the present invention is provided for electrostatically coating a surface of an electrically grounded object to be coated with charged powder coating material. The method comprises the steps of: spraying the powder coating material from a gun main body toward the object to be coated; and impressing a pulse-shaped high voltage upon at least one corona electrode arranged at a tip end of the gun main body to generate a corona discharge thereby to charge the powder coating material thus sprayed.

DETAILED DESCRIPTION OF THE INVENTION

Now, preferred embodiments of the present invention will be described below in detail while referring to the accompanying drawings.

1. First Embodiment

Figure 1:
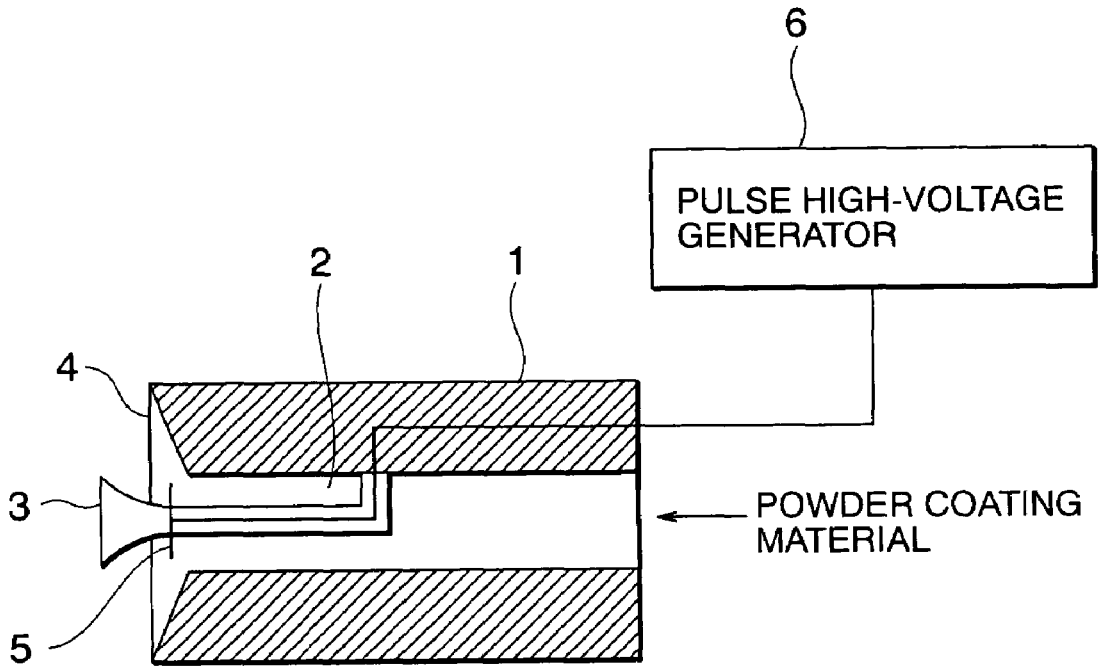
FIG. 1 is a view showing the configuration of a powder coating apparatus according to a first embodiment of the present invention.

FIG. 1 shows the configuration of a powder coating apparatus according to a first embodiment of the present invention. The powder coating apparatus includes a gun main body 1 of a substantially cylindrical shape, with a powder conduit or passage 2 being formed on the central axis of the gun main body 1. The powder conduit 2, after being arranged along the outer periphery of a diffuser 3 to form a cylindrical shape, is connected with an annular nozzle opening 4 at a foremost portion of the gun main body 1. A plurality of corona electrodes 5 of the pin type, being held by the diffuser 3, are arranged inside the nozzle opening 4 in a manner as to protrude radially therefrom. The corona electrodes 5 are electrically connected with one another, and they are also connected with a pulse high-voltage generator 6.

Figure 2:
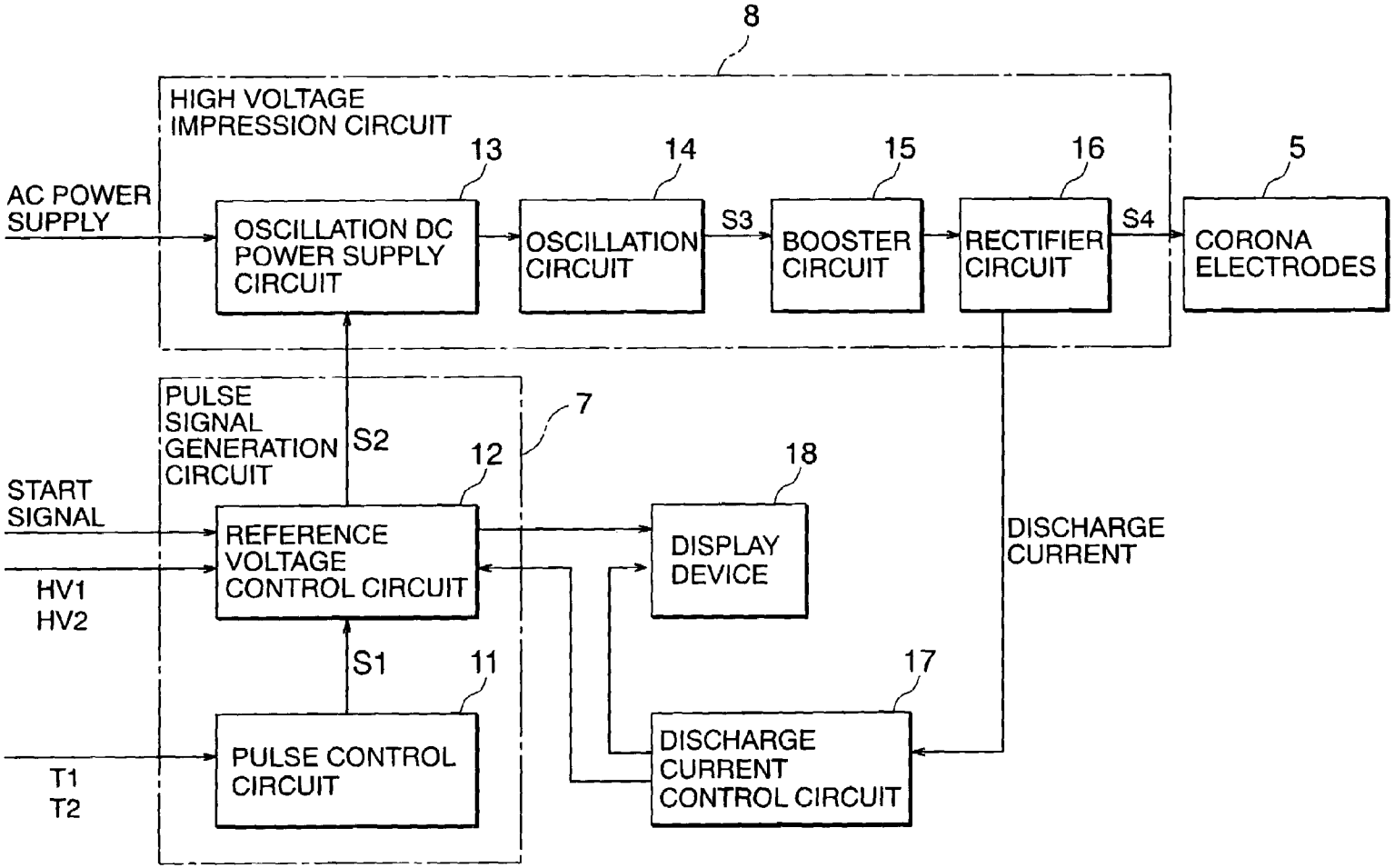
FIG. 2 is a block diagram showing the circuit configuration of a pulse high-voltage generator used in the first embodiment.

The circuit configuration of the pulse high-voltage generator 6 is illustrated in FIG. 2. The pulse high-voltage generator 6 includes a pulse signal generation circuit 7 that generates a pulse signal of a low voltage, and a high voltage impression circuit 8 that boosts the pulse signal, generated by the pulse signal generation circuit 7, to a high voltage so as to impress it upon the corona electrodes 5. The pulse signal generation circuit 7 has a pulse control circuit 11 and a reference voltage control circuit 12 connected with the pulse control circuit 11, to which the values of a pulse width T1 and a pulse interval T2 are input from the outside. A start signal is input from the outside to the reference voltage control circuit 12, together with the values of a peak voltage HV1 and a base voltage HV2 of a pulse-shaped high voltage to be impressed on the corona electrodes 5. On the other hand, the high voltage impression circuit 8 includes an oscillation DC power supply circuit 13, an oscillation circuit 14, a booster circuit 15 and a rectifier circuit 16, mutually connected in series with one another. An external AC power supply is connected with the oscillation DC power supply circuit 13.

In addition, the rectifier circuit 16 of the high voltage impression circuit 8 is connected with the reference voltage control circuit 12 of the pulse signal generation circuit 7 through a discharge current control circuit 17, and a display device 18 is also connected with the reference voltage control circuit 12.

Figure 3:
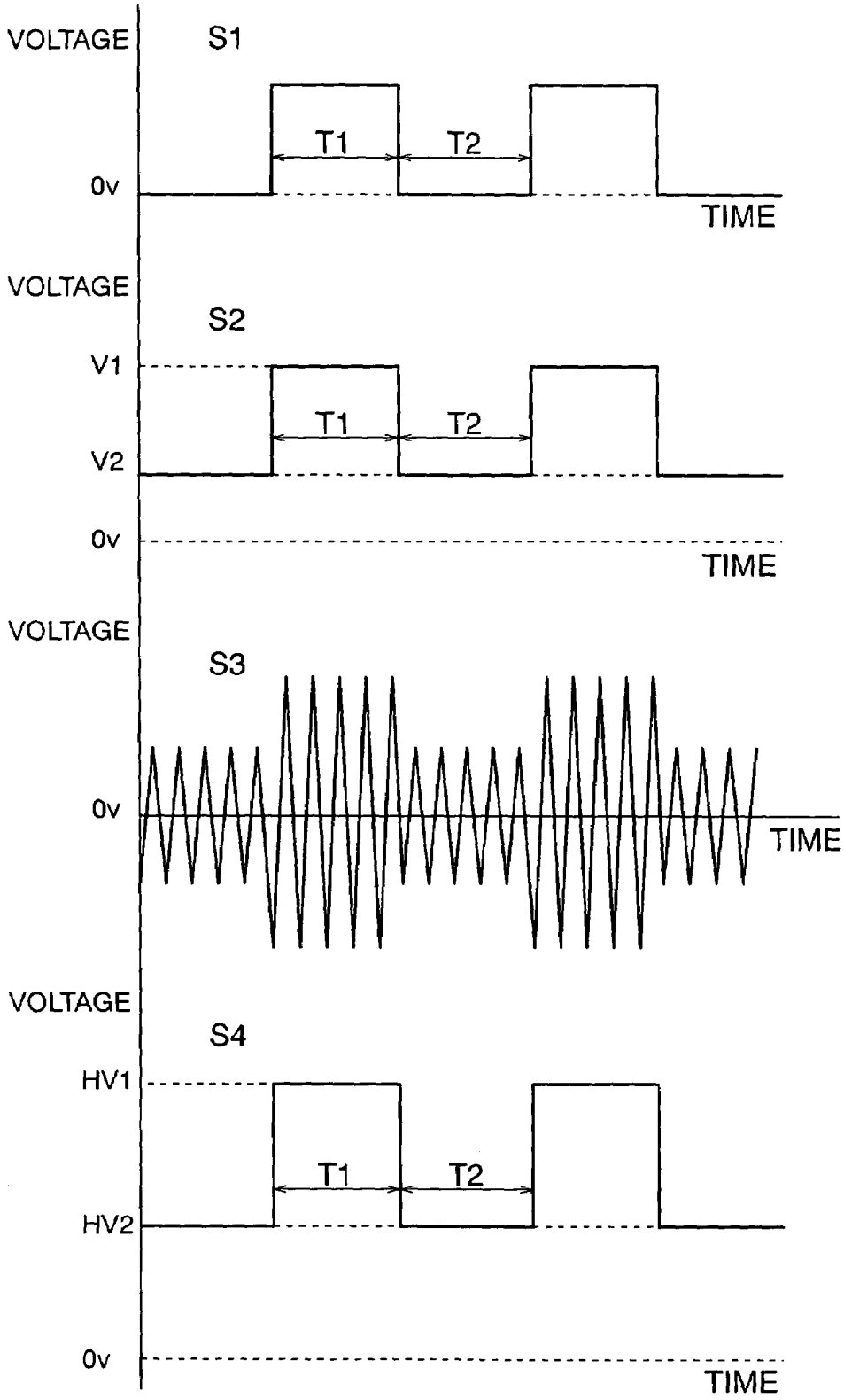
FIG. 3 is a signal waveform chart showing the operation of the pulse high-voltage generator used in the first embodiment.

Now, the operation of this embodiment will be described below. First of all, as shown in FIG. 3, based on the values of the pulse width T1 and the pulse interval T2 input from the outside, a pulse signal S1 of a low voltage having these pulse widths T1 and pulse intervals T2 is formed in the pulse control circuit 11 of the pulse high-voltage generator 6, and output to the reference voltage control circuit 12. Here, note that the pulse width T1 and the pulse interval T2 are set to values from several milliseconds to several hundred milliseconds, e.g., values of 5 to 500 milliseconds.

As shown in FIG. 3, the pulse signal S1 is shaped into a pulse signal S2 of a low voltage having a peak voltage V1 and a base voltage V2 corresponding to the values of the peak voltage HV1 and the base voltage HV2 input from the outside, respectively, in the reference voltage control circuit 12. In addition, when a start signal is input from the outside to the reference voltage control circuit 12, the pulse signal S2 is output to the oscillation DC power supply circuit 13 of the high voltage impression circuit 8.

The pulse signal S2 input from the reference voltage control circuit 12 is amplified by the oscillation DC power supply circuit 13, and then converted into a high frequency signal S3 by the oscillation circuit 14, as shown in FIG. 3. The high frequency signal S3 is input to the booster circuit 15, where it is boosted to a high voltage. Thereafter, the high frequency signal S3 is rectified by the rectifier circuit 16 to form a pulse-shaped high voltage signal S4 having the peak voltage HV1 and the base voltage HV2, as shown in FIG. 3. Here, note that the peak voltage HV1 is set to a value of from 50 to 150 KV, and the base voltage HV2 is set to a value of from 0 to 50 KV, for instance. Since the pulse width T1 and the pulse interval T2 are set to large values such as from several milliseconds to several hundred milliseconds, it is possible to perform rectification in the general-purpose rectifier circuit 16 while reproducing the pulse waveform to a satisfactory extent.

By impressing the pulse-shaped high voltage signal S4 upon the corona electrodes 5, a corona discharge is intermittently generated from the corona electrodes 5 toward an object to be coated at a period T (=pulse width T1+pulse interval T2). Under such a condition, powder coating material is supplied to the powder conduit 2 together with carrier air, and it is injected or sprayed from the annular nozzle opening 4 in a forward direction. The powder coating material thus sprayed is charged with negative ions which are generated by the corona discharge developing from the corona electrodes 5 toward the object to be coated, and thereafter the powder coating material thus charged is directed toward the object to be coated so that it is deposited on the surface of the object to be coated.

Here, note that by the impression of the pulse-shaped high voltage signal S4, the corona discharge is intermittently generated from the corona electrodes 5 at a period of about several milliseconds to several hundred milliseconds, and hence negative ions produced by the corona discharge are not filled in a space between the gun main body 1 and the object to be coated. Therefore, the action of suppressing the corona discharge resulting from the space charge of the negative ions becomes limited, so that a uniform corona discharge is generated from the corona electrodes 5 during the impression of the high voltage signal S4. As a result, the efficiency of coating the object to be coated is improved.

Moreover, the impression of the pulse-shaped high voltage signal S4 serves to decrease a discharge current Id without lowering an impression voltage by properly adjusting the pulse width T1 and the pulse interval T2. Also, since a uniform corona discharge is generated from the corona electrodes 5, there takes place no local concentration of the discharge current Id, thus making a back ionization less apt to occur. Accordingly, it becomes possible to obtain a coating film with excellent quality.

Incidentally, note that the discharge current Id accompanying the corona discharge from the corona electrodes 5 is monitored by means of the discharge current control circuit 17 through the rectifier circuit 16 of the high voltage impression circuit 8, so that it is compared with a cut-off current value Ith preset in the discharge current control circuit 17. The adjustment of the pulse width T1 and the pulse interval T2 of the pulse signal S2, i.e., the adjustment of the duty ratio thereof, is performed by means of the reference voltage control circuit 12 based on the result of the comparison in the discharge current control circuit 17 so that the discharge current Id does not exceed the cut-off current value Ith. Further, the peak voltage HV1 and the base voltage HV2 of the high voltage signal S4 impressed upon the corona electrodes 5, the discharge current Id, the cut-off current value Ith and the like are displayed on the display device 18, whereby an operator can grasp the operating condition of the pulse high-voltage generator 6.

As described above, since the pulse width T1 and the pulse interval T2 are set to large values such as from several milliseconds to several hundred milliseconds, merely by boosting the pulse signal S2 of a low voltage generated in the pulse signal generation circuit 7 by means of the high voltage impression circuit 8, a pulse waveform is reproduced in the rectifier circuit 16 to a satisfactory extent to provide the pulse-shaped high voltage signal S4 which is to be impressed upon the corona electrodes 5. Therefore, pulse charging can be achieved with the single high voltage impression circuit 8 alone. Accordingly, it becomes possible to reduce the size and cost of the powder coating apparatus of high performance.

Although in the above-mentioned first embodiment, the duty ratio of the pulse signal S2 is adjusted by the reference voltage control circuit 12 so that the discharge current Id does not exceed the cut-off current value Ith, the present invention is not limited to this, that is, the reference voltage control circuit 12 may adjust the values of the peak voltage V1 and the base voltage V2 of the pulse signal 52 so as not to allow the discharge current Id to exceed the preset cut-off current value Ith.

2. Second Embodiment

Figure 4:
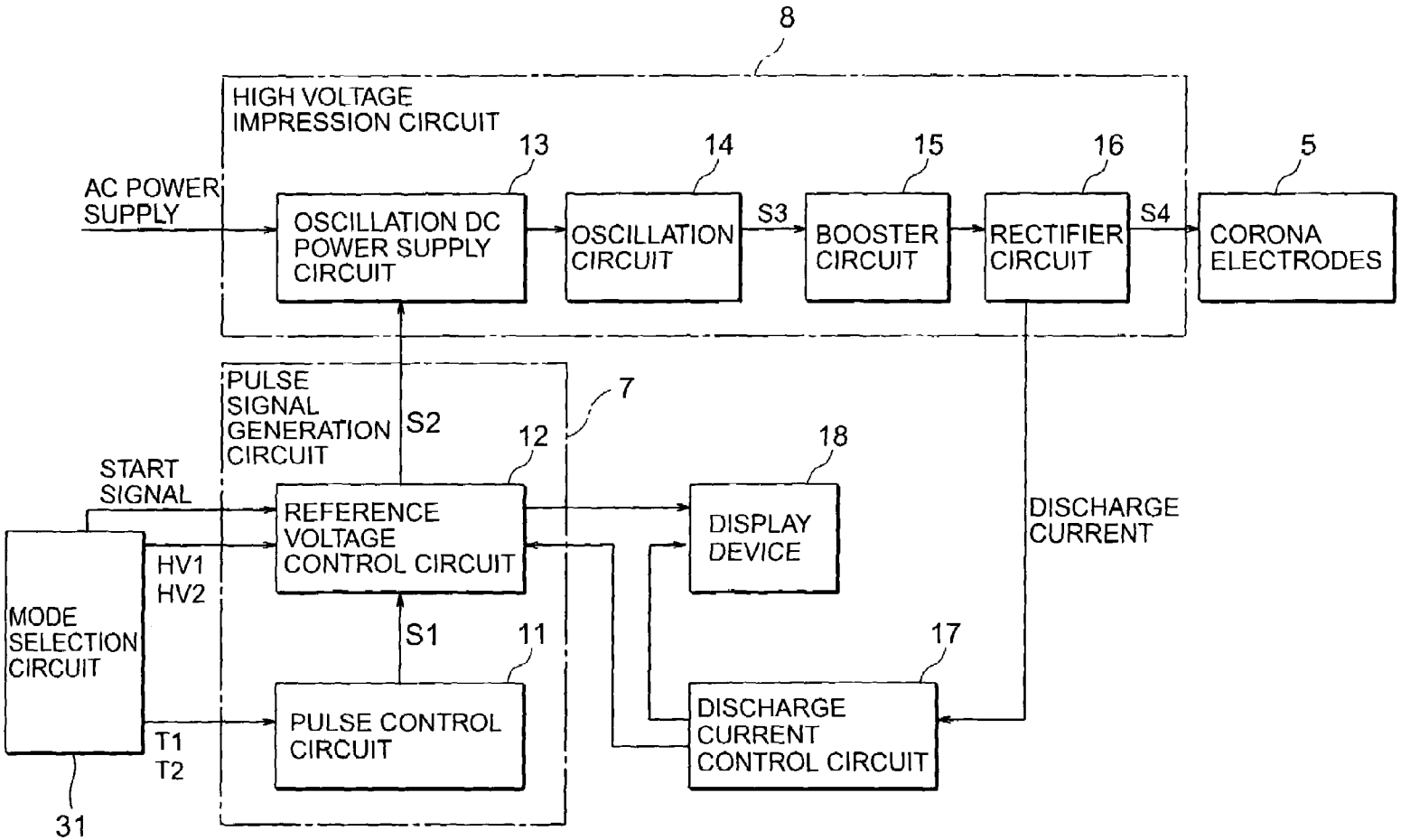
FIG. 4 is a block diagram showing the circuit configuration of a pulse high-voltage generator used in a second embodiment of the present invention.

The circuit configuration of a pulse high-voltage generator used in a second embodiment of the present invention is illustrated in FIG. 4. This pulse high-voltage generator is configured such that a mode selection circuit 31 is connected with the pulse signal generation circuit 7 in the pulse high-voltage generator in the first embodiment shown in FIG. 2. The mode selection circuit 31 stores in advance various combinations of a peak voltage RV1, a base voltage HV2, a pulse width T1 and a pulse interval T2, which are suitable for a plurality of coating modes, respectively, such as a thick-coating mode, a thin-coating mode, a through-coating mode for coating concave portions, a recoating mode for recoating a coating film, etc.

When an operator turns on an unillustrated start switch by selecting one of the coating modes with the mode selection circuit 31, a pulse width T1 and a pulse interval T2 stored therein are input to the pulse control circuit 11, and a peak voltage HV1 and a base voltage HV2 stored therein are input to the reference voltage control circuit 12, in response to the coating mode thus selected, and at the same time, a start signal is input from the mode selection circuit 31 to the reference voltage control circuit 12, so that a pulse-shaped high voltage signal S4 is impressed on the corona electrodes 5 thereby to electrostatically coat or paint the object to be coated, as described in the first embodiment.

With the provision of such a mode selection circuit 31, it becomes possible to carry out coating or painting suitable for a variety of coating modes in an easy manner.

3. Third Embodiment

A powder coating apparatus according to a third embodiment of the present invention is generally similar in configuration to the powder coating apparatus of the first embodiment shown in FIG. 1, but it is different from the first embodiment in the internal configuration of a pulse high-voltage generator 6 connected with corona electrodes 5.

Figure 5:
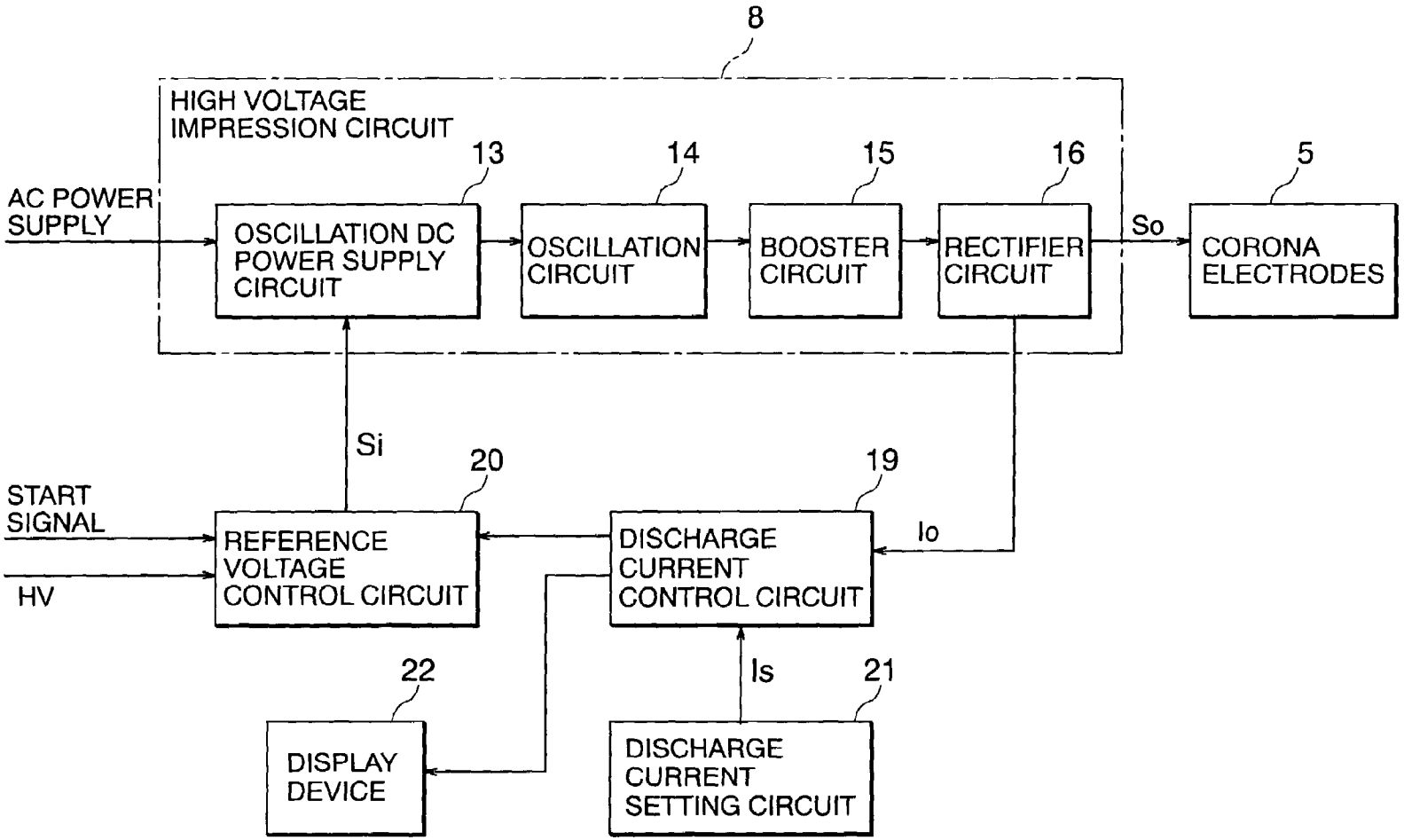
FIG. 5 is a block diagram showing the circuit configuration of a pulse high-voltage generator used in a third embodiment of the present invention.

The circuit configuration of the pulse high-voltage generator used in the third embodiment is illustrated in FIG. 5. The pulse high-voltage generator includes a high voltage impression circuit 8 for impressing a high voltage signal So upon the corona electrodes 5. The high voltage impression circuit 8 comprises an oscillation DC power supply circuit 13, an oscillation circuit 14, a booster circuit 15 and a rectifier circuit 16, which are mutually connected in series with one another, as in the one used in the first embodiment. An external AC power supply is connected with the oscillation DC power supply circuit 13. A discharge current control circuit 19 is connected with the rectifier circuit 16 of the high voltage impression circuit 8, and the oscillation DC power supply circuit 13 is connected with the discharge current control circuit 19 through a reference voltage control circuit 20. These circuit components serve to form a closed feedback circuit. A start signal is input from the outside to the reference voltage control circuit 20, together with a command value of a peak voltage HV of the high voltage signal So to be applied to the corona electrodes 5.

In addition, a discharge current setting circuit 21 and a display device 22 are connected with the discharge current control circuit 19.

Figure 6:
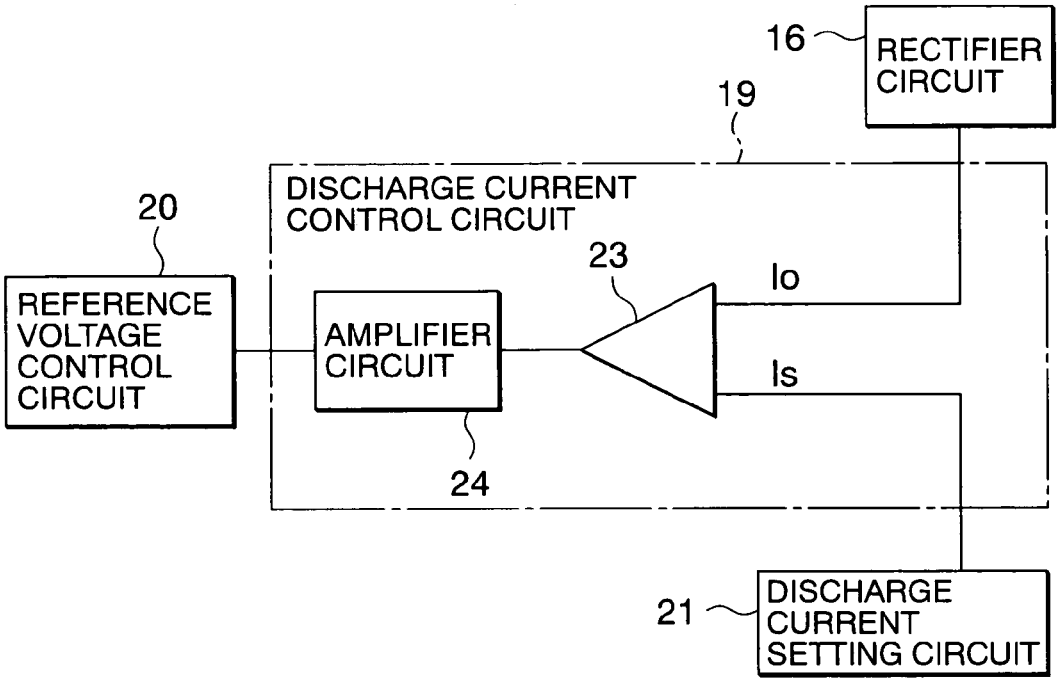
FIG. 6 is a block diagram showing the circuit configuration of a discharge current control circuit used in the third embodiment.

As shown in FIG. 6, the discharge current control circuit 19 includes a comparison circuit 23 that compares the mean value of a discharge current Io, which is obtained from the rectifier circuit 16 of the high voltage impression circuit 8 accompanying the impression of the high voltage signal So upon the corona electrodes 5, with a set value Is output from the discharge current setting circuit 21, and an amplifier circuit 24 connected with an output terminal of the comparison circuit 23. Here, note that the amplifier circuit 24 has a gain Gv greater than an optimal gain Go of the feedback control in the closed feedback circuit.

Now, the operation of the third embodiment will be described below. First of all, a low voltage signal Sv having a voltage corresponding to the command value of the peak voltage RV input from the outside is generated in the reference voltage control circuit 20 of the pulse high-voltage generator. When a start signal is input from the outside, the low voltage signal Sv is output to the oscillation DC power supply circuit 13 of the high voltage impression circuit 8 as an input signal Si. The input signal Si is amplified by the oscillation DC power supply circuit 13, and then it is converted into a high frequency signal in the oscillation circuit 14. This high frequency signal is input to the booster circuit 15, where it is boosted to a high voltage, and thereafter it is rectified by the rectifier circuit 16 to form a high voltage signal So.

Here, a comparison between the mean value of the discharge current Io, obtained from the rectifier circuit 16 of the high voltage impression circuit 8 accompanying the impression of the high voltage signal So upon the corona electrodes 5, and the set value Is output from the discharge current setting circuit 21 is made by the comparison circuit 23 of the discharge current control circuit 19. A difference between them is amplified by the gain Gv in the amplifier circuit 24 to produce a differential signal Sd, which is in turn output to the reference voltage control circuit 20. Then, the differential signal Sd is added to the low voltage signal Sv, which is generated corresponding to the command value of the peak voltage HV in the reference voltage control circuit 20, whereafter the signal in total is output to the oscillation DC power supply circuit 13 of the high voltage impression circuit 8 as an input signal Si. In this manner, feedback control is carried out so as to make the mean value of the discharge current Io equal to the set value Is.

Figure 7:
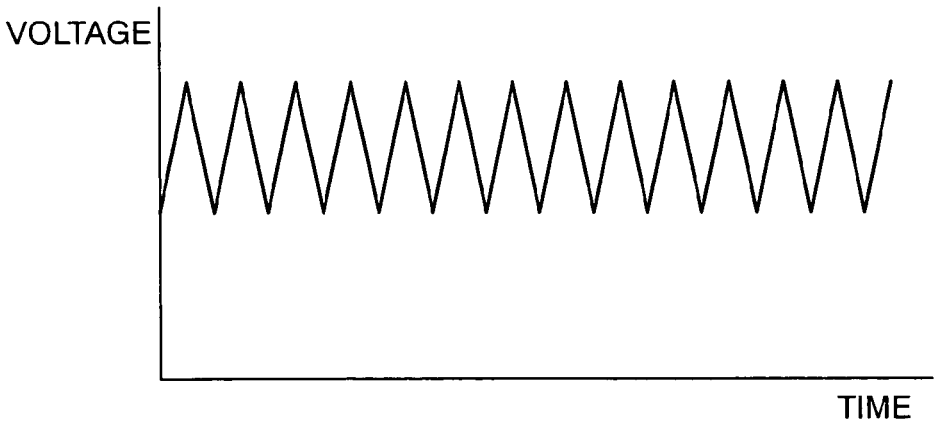
FIG. 7 is a signal waveform chart showing a high voltage signal used in the third embodiment.

At this time, since the amplifier circuit 24 of the discharge current control circuit 19 has the gain Gv greater than the optimal gain Go of the feedback control, the input signal Si output from the reference voltage control circuit 20 to the oscillation DC power supply circuit 13 overshoots, whereby the feedback control is performed in an oscillation state. As a result, the high voltage signal So impressed on the corona electrodes 5 from the high voltage impression circuit 8 becomes a triangular wave-shaped pulse signal of a peak voltage HV of 20 to 100 KV and a period of 10 to 100 milliseconds for instance, as shown in FIG. 7.

By impressing such a pulse-shaped high voltage signal So upon the Corona electrodes 5, there is intermittently developed a corona discharge from the corona electrodes 5 toward the object to be coated. In this condition, powder coating material is supplied to the powder conduit 2 together with carrier air, so that it is sprayed from the annular nozzle opening 4 in a forward direction. The powder coating material thus sprayed is charged by negative ions produced by the corona discharge generated from the corona electrodes 5 toward the object to be coated, and thereafter it is directed toward the object and is deposited on the surface of the object.

Here, note that since the corona discharge is intermittently generated from the corona electrodes 5, the negative ions produced due to the corona discharge are not filled in a space between the gun main body 1 and the object to be coated, and hence the action of suppressing the corona discharge resulting from the space charge of the negative ions becomes limited, whereby a uniform corona discharge is produced from the corona electrodes 5 during the impression of the high voltage signal So. Consequently, the coating efficiency to the object to be coated is improved. In addition, the generation of the uniform corona discharge serves to prevent local concentration of the discharge current Io, thus making it difficult for a back ionization to generate. Accordingly, a coating film with excellent quality can be obtained.

Here, note that the peak voltage HV of the high voltage signal So impressed upon the corona electrodes 5, the mean value and period of the discharge current Io, etc., are displayed on the display device 22 so that an operator can grasp the operating condition of the pulse high-voltage generator.

As described above, only by feedback controlling the high voltage impression circuit 8 in an oscillation state, the pulse-shaped high voltage signal So to be impressed upon the corona electrodes 5 can be obtained, thus making it possible to reduce the size and cost of the powder coating apparatus of high performance.

4. Fourth Embodiment

Figure 8:
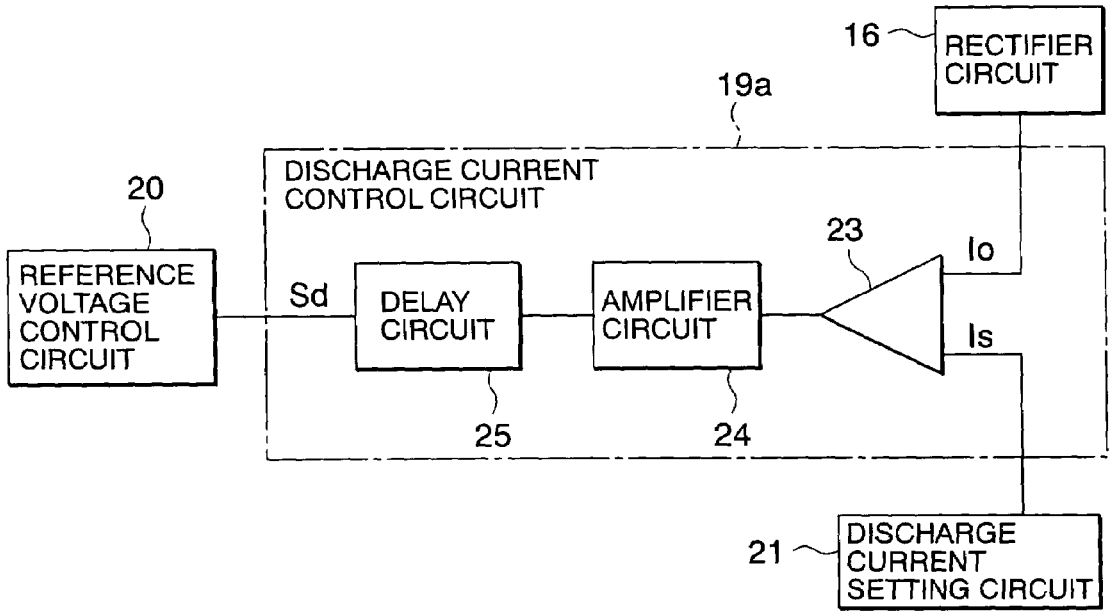
FIG. 8 is a block diagram showing the circuit configuration of a discharge current control circuit used in a fourth embodiment of the present invention.

In the above-mentioned third embodiment, a discharge current control circuit 19*a* of a configuration shown in FIG. 8 can be used instead of the discharge current control circuit 19. The discharge current control circuit 19*a* is further provided with a delay circuit 25 that, in the discharge current control circuit 19 of the third embodiment shown in FIG. 6, serves to delay an output from the comparison circuit 23 and then outputs it to the reference voltage control circuit 20. Since a differential signal Sd delayed in the delay circuit 25 is feedback to the high voltage impression circuit 8 through the reference voltage control circuit 20, the response speed of the feedback control is delayed to produce an oscillation state. Therefore, similar to the third embodiment using the discharge current control circuit 19 of FIG. 6, a triangular wave-shaped high voltage signal So is impressed from the high voltage impression circuit 8 upon the corona electrodes 5, whereby a corona discharge is intermittently generated by the corona electrodes 5.

In this case, the gain of the amplifier circuit 24 may be an optimal gain Go of the feedback control, or it may be a gain Gv greater than the optimal gain Go.

Here, note that the present invention is not limited to a powder coating apparatus provided with a plurality of pin-type corona electrodes 5, as shown in FIG. 1, but can be similarly applied to a powder coating apparatus provided with a single corona electrode or linear electrode.

The invention claimed is:

1. A powder coating apparatus for electrostatically coating a surface of an electrically grounded, said apparatus comprising:

a gun main body for spraying powder coating material toward said object to be coated;

at least one corona electrode arranged at a tip end of said gun main body for charging the powder coating material thus sprayed;

a pulse signal generation circuit for generating a pulse signal having a pulse width and a pulse interval of 5 milliseconds to 500 milliseconds;

an oscillation circuit for converting the pulse signal generated from said pulse signal generation circuit into an oscillating signal;

a booster circuit for boosting a voltage of the oscillating signal converted by said oscillation circuit; and a rectifier circuit for rectifying the oscillating signal boosted by said booster circuit to form a pulse-shaped discharge signal having a pulse width and a pulse interval of 5 milliseconds to 500 milliseconds;

wherein the pulse-shaped discharge signal can be impressed upon said corona electrode to generate a corona discharge.

2. The powder coating apparatus according to claim 1, further comprising:

a discharge current control circuit for comparing a discharge current, which flows accompanying the impression of the discharge signal upon said corona electrode, with a preset cut-off current value; and a reference voltage control circuit for adjusting a duty ratio of the pulse signal generated from said pulse signal generation circuit based on the result of the comparison in said discharge current control circuit in such a manner that the discharge current does not exceed said cut-off current value.

3. The powder coating apparatus according to claim 1, further comprising:

a discharge current control circuit for comparing a discharge current, which flows accompanying the impression of the discharge signal to said corona electrode, with a preset cut-off current value; and a reference voltage control circuit for adjusting a voltage value of the pulse signal generated from said pulse signal generation circuit based on the result of the comparison in said discharge current control circuit in such a manner that the discharge current does not exceed said cut-off current value.

4. The powder coating apparatus according to claim 1, further comprising:

a discharge current control circuit for feedback controlling said oscillation circuit, said booster circuit and said rectifier circuit in an oscillation state in such a manner that a mean value of a discharge current, which flows accompanying the impression of the discharge signal upon said corona electrode, becomes equal to a set value.

5. The powder coating apparatus according to claim 4, wherein said discharge current control circuit comprises:

a comparison circuit for comparing the mean value of the discharge current with said set value; and an amplifier circuit for amplifying an output of said comparison circuit to feedback it to said oscillation circuit, said amplifier circuit having a gain greater than an optimal gain of the feedback control.

6. The powder coating apparatus according to claim 4, wherein said discharge current control circuit comprises:

a comparison circuit for comparing the mean value of the discharge current with said set value; and a delay circuit for delaying the output of said comparison circuit to feedback it to said oscillation circuit.

7. The powder coating apparatus according to claim 6, wherein said discharge current control circuit further comprises an amplifier circuit for amplifying the output of said comparison circuit to input it to said delay circuit.

8. A powder coating method for electrostatically coating a surface of an electrically grounded object to be coated with charged powder coating material, said method comprising generating a pulse signal of a voltage having a pulse width and a pulse interval of 5 milliseconds to 500 milliseconds;

converting the pulse signal into an oscillating signal;

boosting a voltage of the converted oscillating signal;

rectifying the boosted signal to form a pulse-shaped discharge signal having a pulse width and a pulse interval of 5 milliseconds to 500 milliseconds and impressing the pulse-shaped discharge signal upon at least one corona electrode arranged at a tip end of a gun main body to generate a corona discharge; and spraying the powder coating material from the gun main body toward the object to be coated thereby to charge the powder coating material thus sprayed and deposit the powder coating material thereon.

9. The powder coating method according to claim 8, further comprising:

impressing the discharge signal upon said corona electrode, and feedback controlling the discharge signal in an oscillation state in such a manner that a mean value of a discharge current, which flows accompanying the impression of the discharge signal, becomes equal to a set value.

10. The powder coating method according to claim 9, further comprising:

forming the oscillation state by setting a gain to a value greater than an optimal gain of the feedback control.

11. The powder coating method according to claim 9, further comprising forming the oscillation state by delaying a response speed of the feedback control.

* * * * *